US006894555B2

(12) United States Patent
Liu

(10) Patent No.: US 6,894,555 B2
(45) Date of Patent: May 17, 2005

(54) BANDGAP REFERENCE CIRCUIT

(75) Inventor: Ming-Huang Liu, Hsinchu (TW)

(73) Assignee: Industrial Technology Research Institute, Chutung Hsinchu (TW)

( * ) Notice: Subject to any disclaimer, the term of this patent is extended or adjusted under 35 U.S.C. 154(b) by 0 days.

(21) Appl. No.: 10/622,793

(22) Filed: Jul. 21, 2003

(65) Prior Publication Data

US 2004/0169549 A1 Sep. 2, 2004

(30) Foreign Application Priority Data

Feb. 27, 2003 (TW) ..... 92104334 A

(51) Int. Cl.[7] ..... G05F 1/10
(52) U.S. Cl. ..... 327/539
(58) Field of Search ..... 327/530, 534, 327/535, 537, 538, 539, 560, 561, 562, 563

(56) References Cited

U.S. PATENT DOCUMENTS 6,281,743 B1 * 8/2001 Doyle ..... 327/539
6,362,612 B1 * 3/2002 Harris ..... 323/312
6,507,179 B1 * 1/2003 Jun et al. ..... 323/313
6,529,066 B1 * 3/2003 Guenot et al. ..... 327/539

* cited by examiner

*Primary Examiner*—Jeffrey Zweizig
(74) *Attorney, Agent, or Firm*—Bacon & Thomas, PLLC

(57) ABSTRACT

A bandgap reference circuit for generating a reference voltage includes an operational amplifier; a plurality of transistors connected to the operational amplifier; a plurality of resistances connected to the plurality of transistors; and a plurality of bipolar transistors connected to the plurality of resistances. First and second resistances of the plurality of resistances are used for voltage level shifting so that the operational amplifier can normally operate.

2 Claims, 3 Drawing Sheets

BANDGAP REFERENCE CIRCUIT

BACKGROUND OF THE INVENTION

1. Field of the Invention

The present invention relates to a bandgap reference circuit, and particularly to a bandgap reference circuit for generating a low reference voltage.

2. Description of the Prior Art

Please refer to FIG. 1. FIG. 1 is a perspective diagram of a prior art bandgap reference circuit 10. The bandgap reference circuit 10 is used for generating a reference voltage VREF1. The bandgap reference circuit 10 comprises a cascode current mirror 12, and a start circuit 14 composed of transistors M9, M10 and M11 for starting up the bandgap reference circuit 10.

When the current passing through the bipolar junction transistors (BJT) Q1 and !2 is equal to each other, by means of the transistors M5 and M6, the voltages of the nodes N5 and N6 are equal to each other. When the size of the BJT Q2 is larger than that of the BJT Q1, and the voltages of the node N6 and N5 are equal because of the cascode current mirror, a first current directly proportional to the surrounding temperature will be outputted from the transistor M7 and M8. Because the emitter-base voltage of the BJT Q3 is inversely proportional to the surrounding temperature, a reference voltage VREF1 irrelevant to the surrounding temperature will be generated when the first current passes through the resistance R2 and bipolar junction transistor Q3.

The cascode current mirror 12 makes the lowest power source path of the bandgap reference circuit 10 be M2-M4-M6-R1-Q2, and the voltage value of the reference voltage VREF1 is (2Vtp+3Vds,sat+VR1+Veb). Vtp is a threshold voltage of a P-type transistor and is about 0.7V. Vds,sat is the lowest voltage of a P-type or N-type transistor when operating in the saturation region and is about 0.3V. VR1 is a cross-voltage of the resistance R1 and is about 0.1V. Veb is the emitter-base voltage of the transistor Q2 and is about 0.6V. therefore, the lowest voltage value of the reference voltage VREF1 is about 3.0V.

Please refer to FIG. 2. FIG. 2 is a perspective diagram of another prior art bandgap reference circuit 20. The bandgap reference circuit 20 is used for generating a reference voltage VREF2. The bandgap reference circuit 20 comprises an operational amplifier 22, resistances R1·R2·R3, and bipolar junction transistors Q1 and Q2 so as to form a circuit having a temperature compensation function the same as that of the bandgap reference circuit 10. The operational amplifier 22 is only suitable to the input of the P-type transistor because the operational amplifier input common mode voltage is limited by the bipolar junction voltage which is about 0.6V. So, the voltage value of the reference voltage VREF2 is (Vtp+2Vds,sat+Veb) of which the lowest voltage is about 1.9V.

Nowadays, most of the portable electric devices use mixed integrated circuits, such as analog-to-digital converters (ADC), digit-to-analog converters (DAC) and so on, which have to use relatively low reference voltages, such as 1.5V. Because the reference voltages VREF1, VREF2 generated by the bandgap reference circuits 10, 20 are about 3.0V, 1.9V, respectively, which are relatively high, there are problems produced when applying the reference voltages VREF1, VREF2.

SUMMARY OF THE INVENTION

Therefore, the main objective of the present invention is to provide a bandgap reference circuit for generating a low reference voltage. The bandgap reference circuit of the present invention uses serially connected resistances and an operational amplifier of which an input differential pair is an N-type metal oxide semiconductor (MOS) so that the bandgap reference circuit can operate under a low voltage.

The present invention relates to a bandgap reference circuit for generating a reference voltage. The bandgap reference circuit comprises an operational amplifier comprising first and second input ends and an output end; a plurality of transistors connected to the operational amplifier; a plurality of resistances connected to the plurality of transistors; and a plurality of bipolar junction transistors separately connected to the plurality of resistances. First and second resistances of the plurality of resistances are used for voltage level shifting so that the operational amplifier with N-type input transistors can normally operate.

The first input end of the operational amplifier is connected to the drain of the first transistor of the plurality of transistors, the second input end is connected to the drain of the second transistor of the plurality of transistors, and the output end is connected to the gates of the plurality of transistors. One end of the first resistance is connected to the first input end of the operational amplifier, and the second resistance is connected to the second input end of the operational amplifier. Besides, the operational amplifier comprises a plurality of transistors, and uses a N-type metal oxide semiconductor as an input differential pair.

By means of the mentioned circuit, the bandgap reference circuit of the present invention can generate a lower reference voltage, for example, the voltage is less than 1.5V. Therefore, the bandgap reference circuit of the present invention is very suitable to be applied in the portable electric device.

These and other objectives of the present invention will no doubt become obvious to those of ordinary skill in the art after having read the following detailed description of the preferred embodiment, which is illustrated in the various figures and drawings.

BRIEF DESCRIPTION OF THE DRAWINGS

The accompanying drawings, which are incorporated in and form part of the specification in which like numerals designate like parts, illustrate preferred embodiments of the present invention and together with the description, serve to explain the principles of the invention. In the drawings.

DETAILED DESCRIPTION OF THE PREFERRED EMBODIMENT

Figure 1:
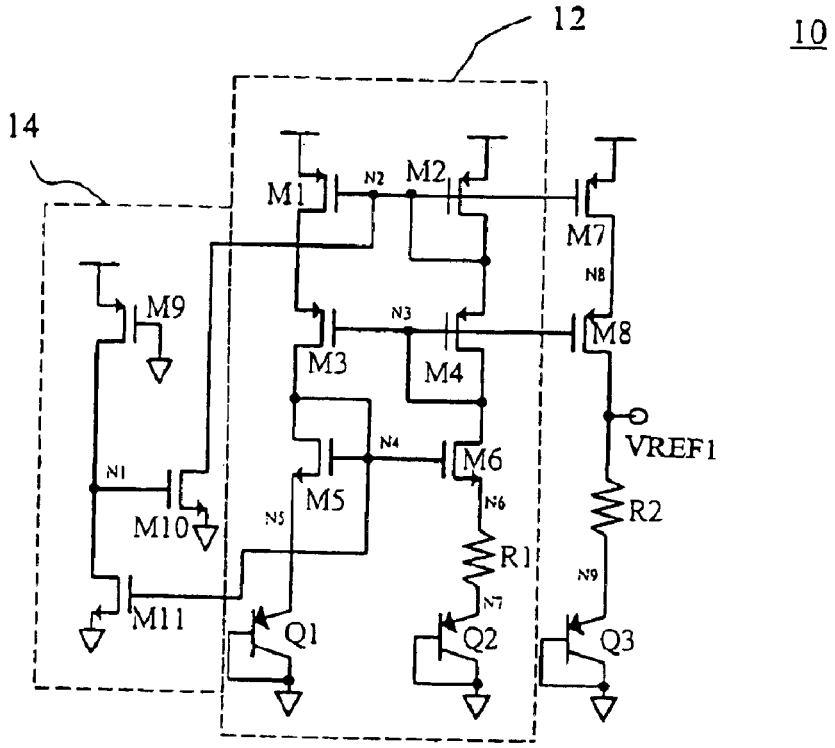
Fig 1 (Prior art)
FIG. 1 is a perspective diagram of a prior art bandgap reference circuit.
Figure 2:
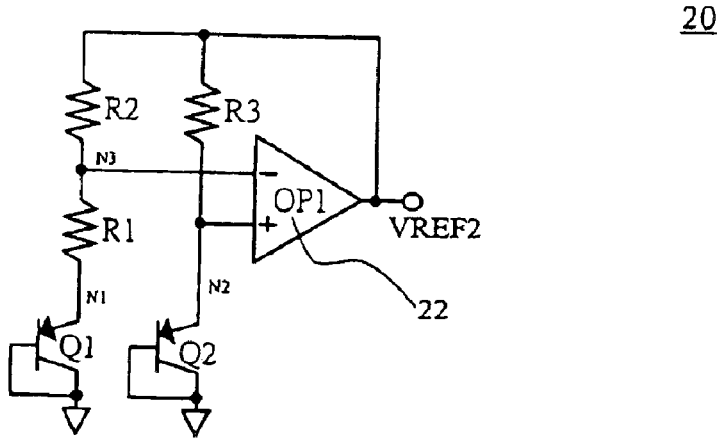
Fig 2 (Prior art)
FIG. 2 is a perspective diagram of another prior art bandgap reference circuit.
Figure 3:
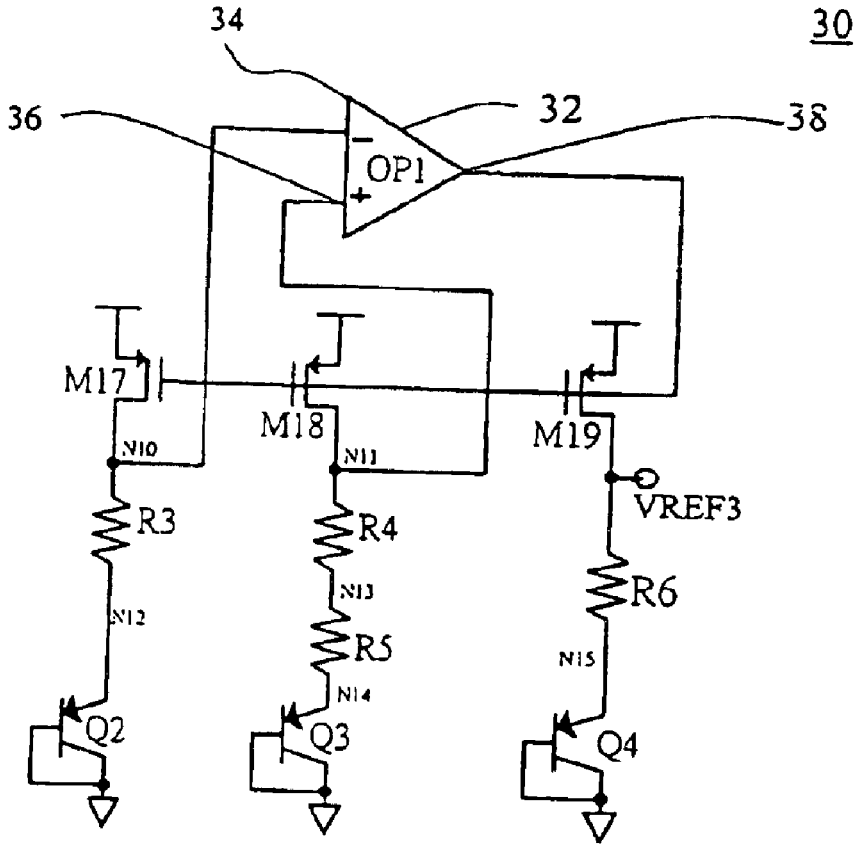
FIG. 3 is a perspective diagram of a bandgap reference circuit according to the present invention.

FIG. 3 is a perspective diagram of a bandgap reference circuit 30 according to the present invention. The bandgap reference circuit 30 is used for generating a reference voltage VREF3. The circuit 30 comprises an operational amplifier 32; transistors M17, M18, M19 connected to the operational amplifier 32; resistances R3, R4, R5, R6 connected to the transistors M17, M18, M19; and bipolar junction transistors Q2, Q3, Q4 connected to the resistances R3, R4, R5, R6. The operational amplifier 32 uses a N-type metal oxide semiconductor as an input differential pair, and the resistances R3 and R4 are used for voltage level shifting so that the operational amplifier 32 can operate normally.

As shown in FIG. 3, the operational amplifier 32 comprises first and second input ends 34, 36, and an output end 38. The first input end 34 is connected to the drain of the transistor M17, the second input end 36 is connected to the drain of the transistor 18, and the output end 38 is connected to the gates of the transistors M17, M18, M19. Besides, one end of the resistance R3 is connected to the first input end 34 of the operational amplifier 32, and the resistance R4 is connected to the second input end 36 of the operational amplifier 32.

Figure 4:
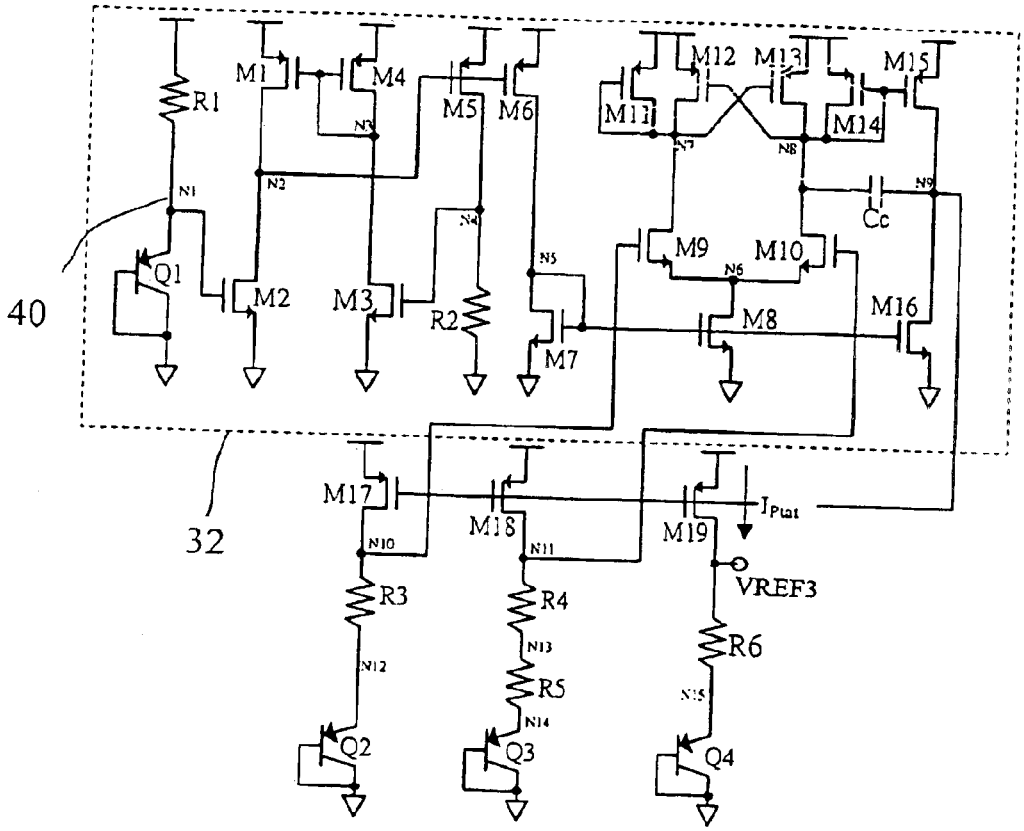
FIG. 4 is a detail drawing of the operational amplifier of the bandgap reference circuit according to the present invention.

Please refer to FIG. 4. FIG. 4 is a detail drawing of the operational amplifier 32 of the bandgap reference circuit 30 according to the present invention. The operational amplifier 32 comprises a plurality of transistors M7–M16, and a bias circuit 40 comprising a bipolar junction transistor Q1, resistances R1, R2, and transistors M1–M6 for generating and outputting a bias current to the operational amplifier 32. As shown in FIG. 4, the lowest power source path of the operational amplifier 32 is M8–M10–M14*m* and the voltage value is (Vtn+3Vds,sat). Vtn is a threshold voltage of a N-type transistor and is about 0.5V. Vds,sat is the lowest voltage of a P-type or N-type transistor when operating in the saturation region and is about 0.3V. Therefore, the voltage value is about 1.4V. The mentioned threshold voltage is illustrated when 0.25 um process technology is applied.

The basic operations of the bandgap reference circuit 30 of the present invention are similar to the prior art bandgap reference circuits. The operational amplifier 32 of the bandgap reference circuit 30 is operated in a status of negative feedback. When the circuit has stabilized, the voltages at nodes N10, N11 will be equal to each other, and the current passing through the transistor M17, M18 will also be equal to each other. If the resistances R3 and R4 are matching, the voltages at nodes N12, N13 are equal to each other. Therefore, the transistors M17 and M18, the bipolar junction transistors Q2 and Q3, and the resistances R3, R4, R5 will generate a current Iptat proportional to the surrounding temperature. The current Iptat is equal to (Vt×1n(M)/R5). Vt is coefficient proportional to an absolute surrounding temperature, and M is ratio of the areas of the transistors Q3 and Q2.

When the current Iptat passes through the transistor M19, and then passes through the resistance R6 and the bipolar junction transistor Q4, the reference voltage VREF3 will be obtained, and the reference voltage VREF3 is equal to (Iptat×R6+Veb). Because Veb is inversely proportional to the surrounding temperature as mentioned above, the obtained reference voltage VREF3 is irrelevant to the surrounding temperature, and the reference voltage VREF3 is typical about 1.2V. Furthermore, the resistances R3 and R4 will increase the input voltage of the operational amplifier 32, originally about 0.7V, up to about 1.1V so that the operational amplifier 32 can normally operate.

Figure 5:
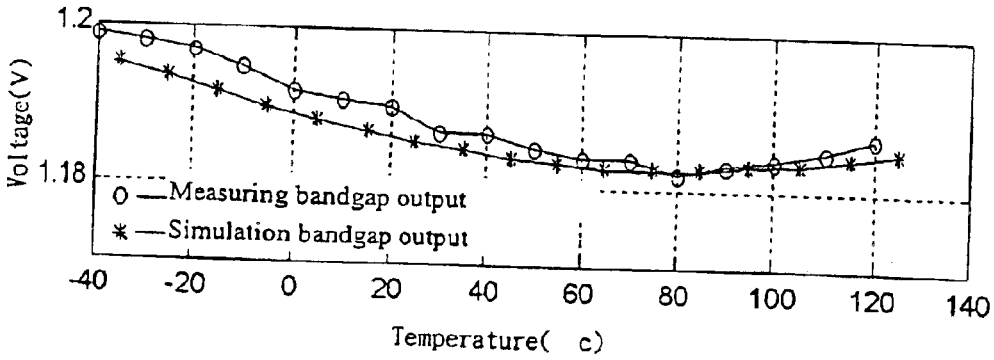
FIG. 5 shows the relation between the surrounding temperature and the reference voltage generated by the bandgap reference circuit.

Please refer to FIG. 5. FIG. 5 shows the relation between the surrounding temperature and the reference voltage VEF3 generated by the bandgap reference circuit 30. FIG. 5 shows the simulation and measure results when the 0.25 um process technology is applied. As shown in FIG. 5, the value of the reference voltage VEF3 generated by the bandgap reference circuit 30 is within the range of 1.18V to 1.2V when the surrounding temperature is within the range of −40° C. to +120° C.

Compared with the prior art, the bandgap reference circuit 30 of the present invention uses an operational amplifier 32 for replacing the cascode current mirror 12, and uses the resistances R3 and R4 for level shifting so that the operational amplifier 32 can normally operate. As the mentioned above, the bandgap reference circuit 30 of the present invention can generate a reference voltage under a lower supply voltage, for example, less than 1.5V. Therefore, the bandgap reference circuit 30 of the present invention can operate under a low voltage, and is suitable for being used in a portable electric device.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A bandgap reference circuit for generating a reference voltage, comprising:

an operational amplifier having an output end, first and second input ends respectively connected to an input differential pair of N-type metal oxide semiconductor transistors, and a bias circuit for outputting a bias current to the operational amplifier;

a plurality of transistors connected to the operational amplifier, wherein the first input end is connected to a drain of a first transistor of the plurality of transistors, the second input end is connected to the drain of a second transistor of the plurality of transistors, and the output end is connected to the gates of the plurality of transistors;

a plurality of resistances connected to the plurality of transistors, wherein a first resistance of the plurality of resistances is connected to said first input end of the operational amplifier, and second and third resistances are connected to said second input end of the operational amplifier, said first and third resistances being matching resistances used for voltage level shifting so that the operational amplifier can normally operate; and a plurality of bipolar junction transistors connected to the plurality of resistances.

2. The bandgap reference circuit of claim 1, wherein the reference voltage is less than or equal to 1.5V.

* * * * *